US010806183B2

(12) United States Patent
Liu

(10) Patent No.: US 10,806,183 B2
(45) Date of Patent: Oct. 20, 2020

(54) ATOMIZATION MODULE OF ELECTRONIC CIGARETTE

(71) Applicant: Tuanfang Liu, Ji'an (CN)

(72) Inventor: Tuanfang Liu, Ji'an (CN)

( * ) Notice: Subject to any disclaimer, the term of this patent is extended or adjusted under 35 U.S.C. 154(b) by 333 days.

(21) Appl. No.: 15/865,243

(22) Filed: Jan. 8, 2018

(65) Prior Publication Data

US 2019/0166908 A1 Jun. 6, 2019

(30) Foreign Application Priority Data

Dec. 6, 2017 (CN) ..... 2017 1 1277498
Dec. 6, 2017 (CN) ..... 2017 2 1684116 U

(51) Int. Cl.

| | |
|---|---|
| ***F24F 6/08*** | (2006.01) |
| ***A24F 47/00*** | (2020.01) |
| ***H05B 3/34*** | (2006.01) |
| *F22B 1/20* | (2006.01) |
| *F24F 6/00* | (2006.01) |

(52) U.S. Cl.
CPC ..... *A24F 47/008* (2013.01); *H05B 3/34* (2013.01)

(58) Field of Classification Search
CPC ..... A24F 47/00; A24F 47/002; A24F 47/004; A24F 47/008; H05B 3/03; H05B 3/04; H05B 3/06; H05B 3/14; H05B 3/16; H05B 3/34; H05B 3/42; H05B 3/44; H05B 3/141
USPC ..... 392/386, 387, 390, 391, 394, 395, 397, 392/398, 403, 404, 405, 406; 131/273, 131/328, 329; 219/211, 270
See application file for complete search history.

(56) References Cited

U.S. PATENT DOCUMENTS

2016/0235121 A1* 8/2016 Rogan ..... A24D 3/041
2016/0309785 A1* 10/2016 Holtz ..... H05B 3/141
2018/0213845 A1* 8/2018 Qiu ..... H05B 3/03

FOREIGN PATENT DOCUMENTS

CN 106263037 A * 1/2017
WO WO-2018126739 A1 * 7/2018 ..... A24F 47/00

* cited by examiner

*Primary Examiner* — Hung D Nguyen
(74) *Attorney, Agent, or Firm* — Matthias Scholl P.C.; Matthias Scholl

(57) ABSTRACT

An atomization module of electronic cigarette, the module including: an end cover; a seal ring; a meshed heating disc; an e-liquid conducting cotton including a surface; and a support. The e-liquid conducting cotton is loaded on the support. The meshed heating disc is disposed on the surface of the e-liquid conducting cotton. The end cover is embedded in the support, which facilitates the cooperation of the meshed heating disc and the e-liquid conducting cotton. The seal ring is disposed on the end cover.

4 Claims, 4 Drawing Sheets

ATOMIZATION MODULE OF ELECTRONIC CIGARETTE

CROSS-REFERENCE TO RELATED APPLICATIONS

Pursuant to 35 U.S.C. § 119 and the Paris Convention Treaty, this application claims foreign priority benefits to Chinese Patent Application No. 201711277498.6 filed Dec. 6, 2017, and to Chinese Patent Application No. 201721684116.7 filed Dec. 6, 2017. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, and Cambridge, Mass. 02142.

BACKGROUND OF THE INVENTION

Field of the Invention

The disclosure relates to an atomization module of electronic cigarette.

Description of the Related Art

Typically, an atomization module of electronic cigarette includes a heating coil, e-liquid conducting cotton, and a fixed seat for fixing the heating coil. The contact area between the heating coil and the e-liquid conducting cotton is relatively small, so the heating is uneven which leads to poor atomization of the e-liquid.

SUMMARY OF THE INVENTION

In view of the above-described problems, it is one objective of the invention to provide an atomization module of electronic cigarettes that heats the e-liquid more evenly.

To achieve the above objectives, in accordance with one embodiment of the invention, there is provided an atomization module of electronic cigarettes, the module comprising: an end cover; a seal ring; a meshed heating disc; an e-liquid conducting cotton comprising a surface; and a support. The e-liquid conducting cotton is loaded on the support; the meshed heating disc is disposed on the surface of the e-liquid conducting cotton; the end cover is embedded in the support to facilitate the cooperation of the meshed heating disc and the e-liquid conducting cotton; and the seal ring is disposed on the end cover.

The e-liquid conducting cotton is linen cotton in the shape of a circle. The linen cotton has better high temperature resistance and stability than common cotton, thus extending the service life of the atomization module. The heating disc is uniformly disposed on the surface of the e-liquid conducting cotton, which increases the contact area of the two components, thus achieving the even heating and better atomization effect. The seal ring is disposed on the end cover, increasing the sealing property of the atomization module. Thus, when the atomization module cooperates with other elements such as cigarette holder, metal sleeve, battery pack and the like, the entire electronic cigarette presents better sealing properties.

In a class of this embodiment, the meshed heating disc is made of iron-chromium metal material and comprises eight concentric circles, and every two concentric circles are connected by three connecting points; the eight concentric circles comprise an outermost circle and an innermost circle; the outermost circle is connected to a negative pole of a power supply, and the innermost circle is connected to a positive pole of the power supply. When the atomization module is electrified, the current generated from the positive connection piece flows from the inner ring to the outer ring of the heating disc and converges at the negative pole to yield heat energy.

The meshed heating disc, the support, the e-liquid conducting cotton and the end cover form an integrated atomization module, so it is easy to replace in case of failure.

Advantages of the atomization module of electronic cigarettes of the disclosure are summarized as follows. The atomization module of the disclosure is an integrated structure, so it is easy to replace in case of failure. The e-liquid conducting cotton employs linen cotton which has better high temperature resistance and stability, thus prolonging the service life of the atomization module. The heating disc is uniformly disposed on the surface of the e-liquid conducting cotton, so the heating is even, improving the atomization effect.

BRIEF DESCRIPTION OF THE DRAWINGS

The invention is described hereinbelow with reference to the accompanying drawings, in which.

DETAILED DESCRIPTION OF THE EMBODIMENTS

For further illustrating the invention, experiments detailing an atomization module of electronic cigarettes are described below.

Figure 1:
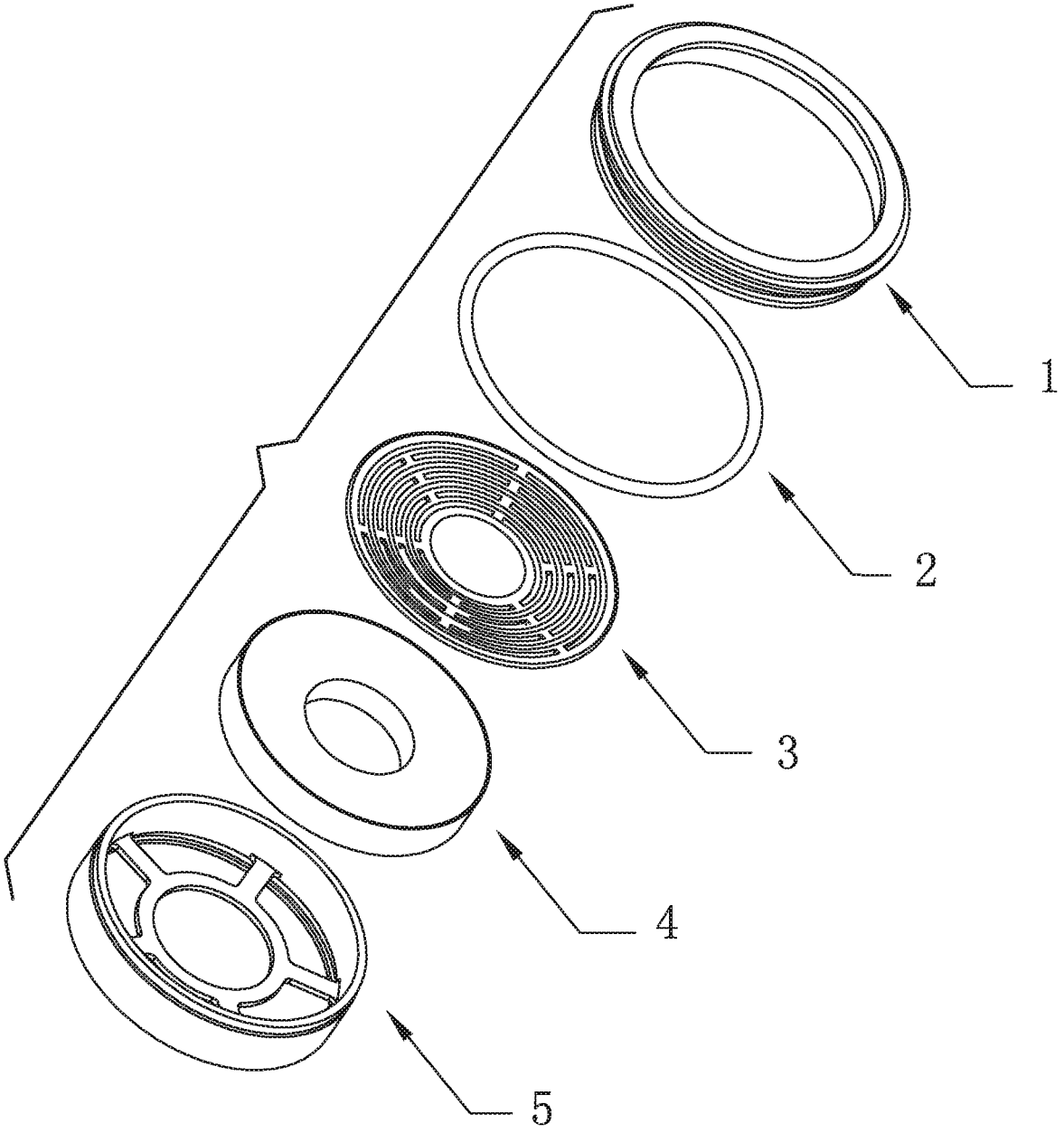
FIG. 1 is an exploded view of an atomization module of electronic cigarettes in accordance with one embodiment of the disclosure.
Figure 2:
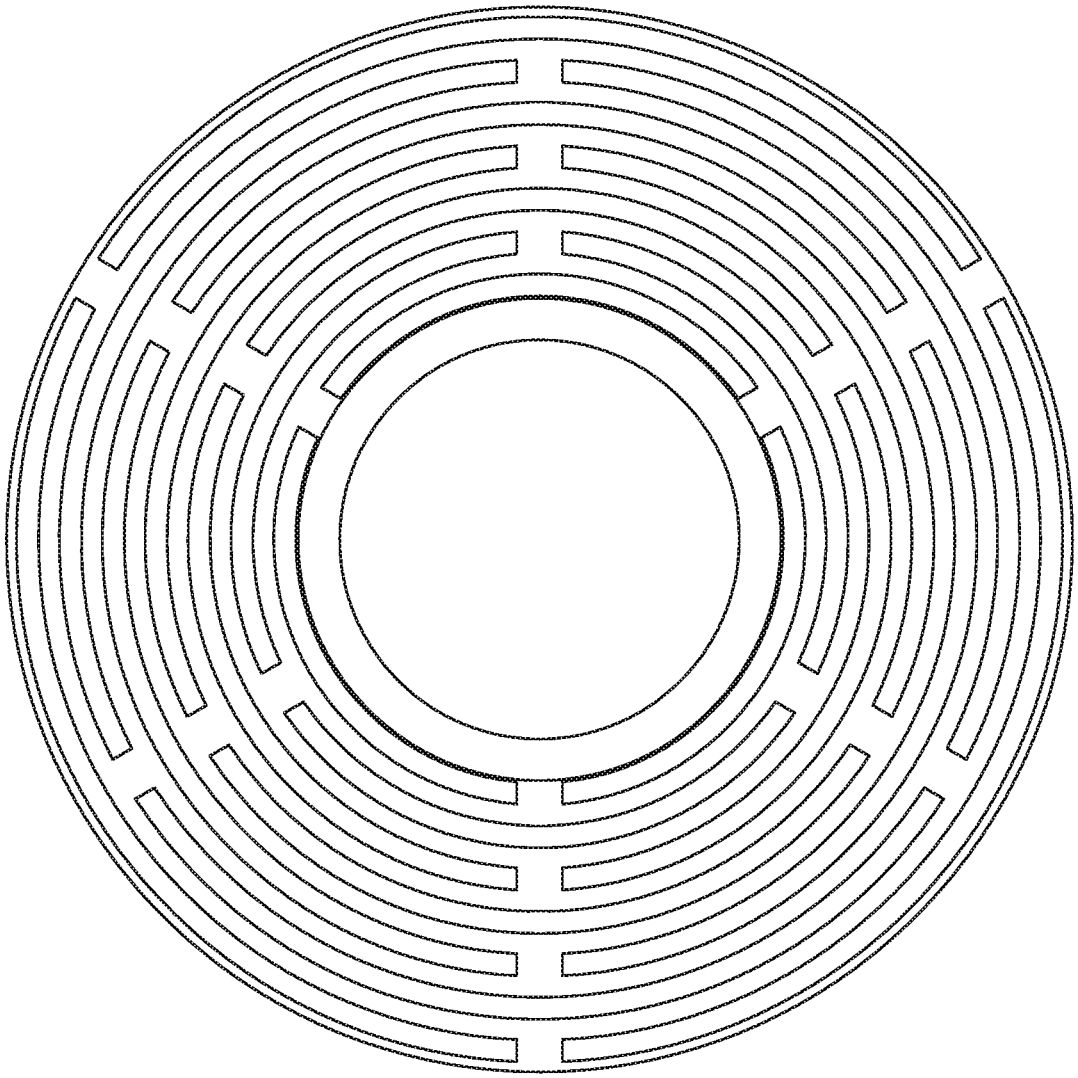
FIG. 2 is a schematic diagram of a meshed heating disc of an atomization module of electronic cigarettes in accordance with one embodiment of the disclosure.
Figure 3:
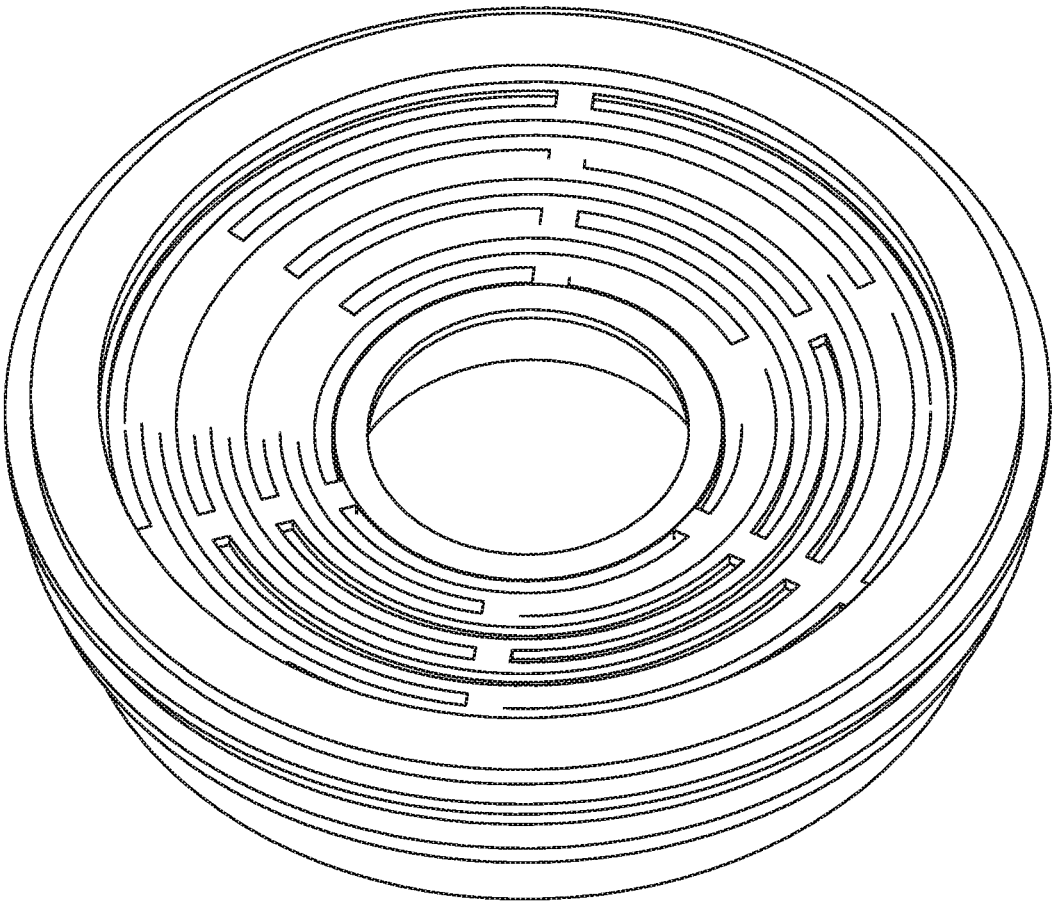
FIG. 3 is a stereogram of an atomization module of electronic cigarettes in accordance with one embodiment of the disclosure.
Figure 4:
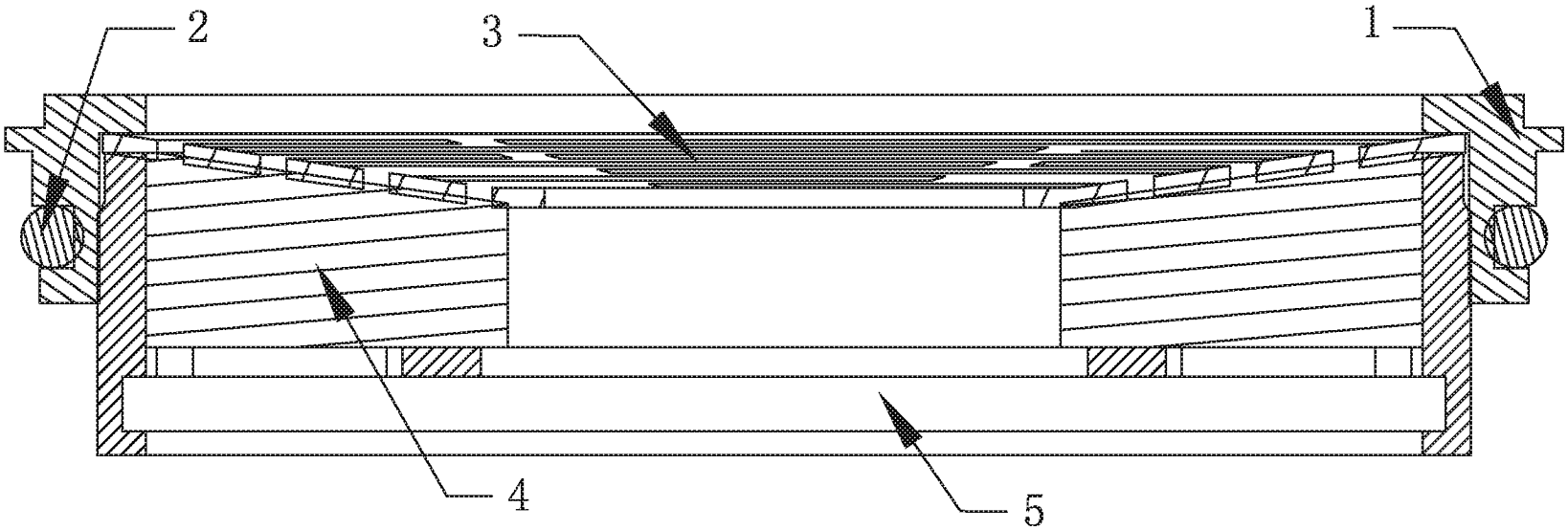
FIG. 4 is a sectional view of an atomization module of electronic cigarettes in accordance with one embodiment of the disclosure.

As shown in FIGS. 1-4, an atomization module of electronic cigarettes comprises an end cover 1; a seal ring 2; a meshed heating disc 3; an e-liquid conducting cotton 4 comprising a surface; and a support. The e-liquid conducting cotton 4 is loaded on the support 5. The meshed heating disc 3 is disposed on the surface of the e-liquid conducting cotton 4. The end cover 1 is embedded in the support 5, which facilitates the cooperation of the meshed heating disc 3 and the e-liquid conducting cotton 4. The seal ring 2 is disposed on the end cover.

The e-liquid conducting cotton 4 is linen cotton in the shape of a circle. The linen cotton has better high temperature resistance and stability than common cotton, so the e-liquid carrying capacity is improved. The heating disc disposed on the surface of the e-liquid conducting cotton, which increases the contact area of the two components, thus achieving the even heating and better atomization effect. The seal ring 2 is disposed on the end cover, increasing the sealing property of the atomization module. Thus, when the atomization module cooperates with other elements such as cigarette holder, metal sleeve, battery pack and the like, the entire electronic cigarette presents better sealing properties.

The meshed heating disc 3 is made of iron-chromium metal material and comprises eight concentric circles, every two concentric circles are connected by three connecting points, an outermost circle of the eight concentric circles is connected to a negative pole of a power supply, and an innermost circle of the eight concentric circles is connected to a positive pole of the power supply. When the atomization module is electrified, the current generated from the positive connection piece flows from the inner ring to the outer ring of the heating disc and converges at the negative pole to yield heat energy.

The meshed heating disc, the support, the e-liquid conducting cotton and the end cover form an integrated atomization module, which is conducive to replace when it is broken down. The e-liquid conducting cotton employs linen cotton which has better high temperature resistance and stability, thus prolonging the service life of the atomization module. The heating disc is uniformly disposed on the surface of the e-liquid conducting cotton, so the heating is even, improving the atomization effect.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An atomization module of electronic cigarettes, the module comprising:

an end cover;

a seal ring;

a meshed heating unit comprising a heating surface;

an e-liquid conducting cotton comprising a top surface; and a support comprising a supporting surface and a sidewall; wherein the e-liquid conducting cotton is disposed on the supporting surface;

the meshed heating unit is disposed on the top surface of the e-liquid conducting cotton and the heating surface abuts against the top surface;

the meshed heating unit and the e-liquid conducting cotton are coaxially disposed around a central axis;

the end cover is disposed on the sidewall of the support;

the seal ring is disposed on the end cover;

a distance between the heating surface and the supporting surface increases along a radial direction away from the central axis; and a distance between the top surface and the supporting surface increases along the radial direction away from the central axis.

2. The module of claim 1, wherein the meshed heating unit is made of iron-chromium metal material and comprises eight concentric circles, and every two concentric circles are connected by three connecting points; the eight concentric circles comprise an outermost circle and an innermost circle; the outermost circle is connected to a negative pole of a power supply, and the innermost circle is connected to a positive pole of the power supply.

3. The module of claim 2, wherein the e-liquid conducting cotton is linen cotton in the shape of a circle.

4. The module of claim 1, wherein the e-liquid conducting cotton is linen cotton in the shape of a circle.

* * * * *